US010589356B2

(12) United States Patent
Nakaseko et al.

(10) Patent No.: US 10,589,356 B2
(45) Date of Patent: Mar. 17, 2020

(54) METHOD FOR PRODUCING WATER-ATOMIZED METAL POWDER

(71) Applicant: JFE STEEL CORPORATION, Tokyo (JP)

(72) Inventors: Makoto Nakaseko, Chiba (JP); Yukiko Ozaki, Fukuoka (JP); Naomichi Nakamura, Chiba (JP)

(73) Assignee: JFE Steel Corporation, Tokyo (JP)

( * ) Notice: Subject to any disclaimer, the term of this patent is extended or adjusted under 35 U.S.C. 154(b) by 180 days.

(21) Appl. No.: 15/561,661

(22) PCT Filed: Mar. 14, 2016

(86) PCT No.: PCT/JP2016/001412
§ 371 (c)(1),
(2) Date: Sep. 26, 2017

(87) PCT Pub. No.: WO2016/157762
PCT Pub. Date: Oct. 6, 2016

(65) Prior Publication Data

US 2018/0071826 A1 Mar. 15, 2018

(30) Foreign Application Priority Data

Mar. 30, 2015 (JP) ..... 2015-068227

(51) Int. Cl.
*B22F 9/08* (2006.01)
*C22C 45/02* (2006.01)
(Continued)

(52) U.S. Cl.
CPC ..... *B22F 9/082* (2013.01); *B22F 9/002* (2013.01); *B22F 9/02* (2013.01); *B22F 9/08* (2013.01);
(Continued)

(58) Field of Classification Search
None
See application file for complete search history.

(56) References Cited

U.S. PATENT DOCUMENTS 3,845,805 A * 11/1974 Kavesh ..... B22D 11/005 164/423
4,647,305 A 3/1987 Kumai et al.
(Continued)

FOREIGN PATENT DOCUMENTS

CN 102717087 A 10/2012
CN 103600084 A 2/2014
(Continued)

OTHER PUBLICATIONS

Non Final Office Action for U.S. Appl. No. 15/129,339, dated Sep. 19, 2018, 12 pages.
(Continued)

*Primary Examiner* — George Wyszomierski
(74) *Attorney, Agent, or Firm* — RatnerPrestia

(57) ABSTRACT

A method for producing a water-atomized metal powder, comprising applying water to a molten metal stream, dividing the molten metal stream into a metal powder, and cooling the metal powder, wherein the metal powder is further subjected to secondary cooling with cooling capacity having a minimum heat flux point (MHF point) higher than the surface temperature of the metal powder in addition to the cooling and the secondary cooling is performed from a temperature range where the temperature of the metal powder after the cooling is not lower than the cooling start temperature necessary for amorphization nor higher than the minimum heat flux point (MHF point).

4 Claims, 5 Drawing Sheets

(51) Int. Cl.
*B22F 9/02* (2006.01)
*B22F 9/00* (2006.01)

(52) U.S. Cl.
CPC ..... *C22C 45/02* (2013.01); *B22F 2009/086* (2013.01); *B22F 2009/0828* (2013.01); *B22F 2009/0832* (2013.01); *B22F 2009/0872* (2013.01)

(56) References Cited

U.S. PATENT DOCUMENTS

| | | | | |
|---|---|---|---|---|
| 7,008,463 | B2 | 3/2006 | Furuya | |
| 7,780,757 | B2 | 8/2010 | Furuya | |
| 9,991,036 | B2 | 6/2018 | Kudo | |
| 10,293,407 | B2 * | 5/2019 | Nakaseko | B22F 9/082 |
| 2005/0236071 | A1 | 10/2005 | Koshiba et al. | |
| 2006/0090595 | A1 | 5/2006 | Furuya | |
| 2007/0246131 | A1 | 10/2007 | Watanabe | |
| 2013/0180360 | A1 | 7/2013 | Kim et al. | |
| 2018/0071826 | A1 | 3/2018 | Nakaseko et al. | |

FOREIGN PATENT DOCUMENTS

| | | | |
|---|---|---|---|
| JP | 03232908 | A | 10/1991 |
| JP | 07107167 | B2 | 11/1995 |
| JP | 2000317513 | A | 11/2000 |
| JP | 3461344 | B2 | 10/2003 |
| JP | 2004349364 | A | 12/2004 |
| JP | 3932573 | B2 | 6/2007 |
| JP | 2007291454 | A | 11/2007 |
| JP | 2009061485 | A | 3/2009 |
| JP | 2010150587 | A | 7/2010 |
| JP | 4784990 | B2 | 10/2011 |
| JP | 4793872 | B2 | 10/2011 |

OTHER PUBLICATIONS

Chinese Office Action for Chinese Application No. 201680019417.X, dated Nov. 5, 2018; with Concise Statement of Search Report—10 pages.

International Search Report and Written Opinion for International Application No. PCT/JP2016/001412, dated Jun. 7, 2016—12 Pages—8 Pages.

Japanese Office Action for Japanese Application No. 2016-544876, dated Aug. 8, 2017, including Concise Statement of Relevance of Office Action, 9 pages.

Korean Office Action for Korean Application No. 10-2017-7027657, dated Mar. 15, 2019 with Concise Statement of Relevance of Office Action, 5 pages.

* cited by examiner (a)

(b)

(a)

(b)

METHOD FOR PRODUCING WATER-ATOMIZED METAL POWDER

CROSS REFERENCE TO RELATED APPLICATIONS

This is the National Phase Application of PCT/JP2016/001412, filed Mar. 14, 2016, which claims priority to JP 2015-068227, filed Mar. 30, 2015, the disclosures of these applications being incorporated herein by reference in their entireties for all purposes.

TECHNICAL FIELD OF THE INVENTION

The present invention relates to a method for producing a metal powder (hereinafter also referred to as a water-atomized metal powder) using a water atomizer and particularly relates to a method for increasing the cooling rate of a metal powder after water atomization.

BACKGROUND OF THE INVENTION

Conventional methods for producing a metal powder include atomization methods. The atomization methods include a water atomization method in which a metal powder is obtained by injecting a high-pressure water jet into a stream of molten metal and a gas atomization method in which an inert gas is ejected instead of a water jet.

In the water atomization method, a stream of molten metal is divided into powdery metal (metal powder) using a water jet ejected from a nozzle and the powdery metal (metal powder) is cooled with the water jet, whereby an atomized metal powder is obtained. On the other hand, in the gas atomization method, a stream of molten metal is divided into powdery metal using an inert gas ejected from a nozzle. Thereafter, the powdery metal (metal powder) is usually cooled in such a manner that the powdery metal is dropped into a water tank or flowing water drum placed under an atomizer, whereby an atomized metal powder is obtained.

In recent years, for example, motor cores for use in electric or hybrid automobiles have been required to have low iron loss from the viewpoint of energy saving. Hitherto, motor cores have been manufactured by stacking electrical steel sheets. Recently, motor cores manufactured from a metal powder (electromagnetic iron powder) with a high degree of freedom in shape design are attracting attention. In order to produce such a motor core with low iron loss, a metal powder with low iron loss needs to be used. In order to allow a metal powder to have low iron loss, the non-crystallization (amorphization) of the metal powder is probably effective. However, in order to obtain a non-crystalline metal powder by an atomization method, crystallization needs to be prevented by rapidly quenching the metal powder in a high-temperature state including a molten state.

Therefore, several methods for quenching a metal powder have been proposed.

For example, Patent Literature 1 describes a method for producing a metal powder in such a manner that the cooling rate until solidification is set to $10^5$ K/s or more when the metal powder is obtained by cooling and solidifying molten metal by scattering the molten metal. In a technique described in Patent Literature 1, the above cooling rate is obtained in such a manner that the scattered molten metal is brought into contact with a coolant stream generated by swirling a coolant along the inner wall of a cylinder. The flow velocity of the coolant stream generated by swirling the coolant is preferably 5 m/s to 100 m/s.

Patent Literature 2 describes a method for producing a rapidly solidified metal powder. In a technique described in Patent Literature 2, a coolant is supplied to a cooling container having an inner surface that is a cylindrical surface from the outside edge of the upper end of a cylindrical portion of the cooling container in a circumferential direction and is dropped in such a manner that the coolant is swirled along the inner surface of the cylindrical portion, a layered swirl coolant layer having a space in a central portion thereof is formed by the centrifugal force due to the swirl, and molten metal is supplied on to the inner circumferential surface of the swirl coolant layer and is rapidly solidified. This allows a high-quality rapidly solidified metal powder to be obtained with good cooling efficiency.

Patent Literature 3 describes an apparatus for producing a metal powder by a gas atomization method. The apparatus includes a gas jet nozzle for dividing molten metal flowing down into molten droplets by ejecting a gas jet and also includes a cooling cylinder including a coolant layer swirling down along the inner surface thereof. In a technique described in Patent Literature 3, molten metal is divided in two stages, with the gas jet nozzle and the swirling coolant layer, respectively, whereby a fine rapidly solidified metal powder is obtained.

Patent Literature 4 describes a method for producing fine amorphous metal particles in such a manner that molten metal is supplied into a liquid coolant, a vapor film is formed in the coolant so as to cover the molten metal, the molten metal is brought into direct contact with the coolant by disrupting the vapor film formed such that boiling is caused by spontaneous nucleation, the molten metal is rapidly cooled to be amorphized while the molten metal is being torn by the pressure wave of the boiling, and the fine amorphous metal particles are thereby obtained. The vapor film covering the molten metal can be disrupted by ultrasonic irradiation or in such a manner that the temperature of the molten metal supplied to the coolant is adjusted such that, when the molten metal is in direct contact with the coolant, the interfacial temperature is not lower than the spontaneous nucleation temperature nor higher than the minimum temperature of film boiling.

Patent Literature 5 describes a method for producing fine particles in such a manner that the temperature of a molten material is set prior to supplying the molten material into a liquid coolant in the form of droplets or a jet stream such that the temperature of the molten material is not lower than the spontaneous nucleation temperature of the liquid coolant and a molten state is kept when the molten material is brought into direct contact with the liquid coolant, the difference in relative speed between the molten material supplied in a stream of the liquid coolant and the liquid coolant stream is adjusted to 10 m/s or more such that a vapor film formed around the molten material is forcedly disrupted and boiling is caused by spontaneous nucleation, and atomization and solidification by cooling are caused, this enabling a conventionally and otherwise difficult material to be atomized and amorphized.

Patent Literature 6 describes a method for manufacturing a functional member. The method includes a step of obtaining polycrystalline or non-crystalline, homogeneous functional fine particles free from segregation in such a manner that a raw material obtained by adding a functional additive to a material serving as a matrix is melted, is supplied into a liquid coolant, and is atomized by vapor explosion and the cooling rate is controlled during solidification by cooling and also includes a step of obtaining the functional member in such a manner that the functional fine particles and fine particles of the matrix are used as raw materials and are solidified.

PATENT LITERATURE

PTL 1: Japanese Unexamined Patent Application Publication No. 2010-150587

PTL 2: Japanese Examined Patent Application Publication No. 7-107167

PTL 3: Japanese Patent No. 3932573

PTL 4: Japanese Patent No. 3461344

PTL 5: Japanese Patent No. 4793872

PTL 6: Japanese Patent No. 4784990

SUMMARY OF THE INVENTION

In order to quench high-temperature molten metal, cooling water is usually brought into contact with the molten metal. However, it is difficult for the surface of the molten metal to come into complete contact with the cooling water. This is because, at the moment when the cooling water comes into contact with the surface (surface to be cooled) of the high-temperature molten metal, the cooling water evaporates to form a vapor film between the cooled surface and the cooling water, resulting in a so-called film boiling state. Therefore, the presence of the vapor film prevents the promotion of cooling.

The techniques described in Patent Literatures 1 to 3 are such that molten metal is supplied into a coolant layer formed by swirling a coolant and a vapor film formed around each metal particle is removed. However, when the temperature of the divided metal particles is high, film boiling is likely to occur in the coolant layer and the metal particles supplied into the coolant layer move together with the coolant layer. Therefore, the difference in relative speed between the coolant layer and each metal particle is small and there is a problem in that it is difficult to avoid film boiling.

In the technique described in each of Patent Literatures 4 to 6, a vapor film covering molten metal is disrupted by vapor explosion in which the chain of transitions from film boiling to nucleate boiling occurs, whereby metal particles are atomized and are further amorphized. Removing the vapor film due to film boiling by vapor explosion is an effective method. In order to induce vapor explosion by causing the continuous transition from film boiling to nucleate boiling, the surface temperature of the metal particles needs to be reduced to the MHF (minimum heat flux) point or lower at the start as is clear from a boiling curve shown in FIG. 6. FIG. 6 is a schematic illustration which is called a boiling curve and which shows the relationship between the cooling capacity and the surface temperature of a cooled material in the case where a coolant is liquid. As is clear from FIG. 6, when the surface temperature of the metal particles is high, cooling to the MHF point corresponds to cooling in a film boiling region. In cooling in the film boiling region, a vapor film is present between a cooled surface and cooling water, resulting in weak cooling. Therefore, in the case where cooling is started from the MHF point or higher for the purpose of amorphizing a metal powder, there is a problem in that the cooling rate for amorphization is too small and insufficient.

In the technique described in each of Patent Literatures 1 to 6, a metal powder is produced by a gas atomization method. The gas atomization method requires a large amount of an inert gas for atomization and therefore has a problem that an increase in production cost is caused.

It is an object of the present invention to provide a method for producing a water-atomized metal powder. In the method, a water atomization method which is a method for producing a metal powder at low cost is used, a metal powder can be rapidly cooled, and an amorphous metal powder can be obtained.

In a usual water atomization method, molten metal is powdered using, for example, a water-atomized metal powder production apparatus shown in FIG. 7. Molten metal 1 is dropped into a chamber 9 in the form of a molten metal stream 8 from a container such as a tundish 3 through a molten metal guide nozzle 4. Needless to say, an inert gas valve 11 is opened such that the chamber 9 has an inert gas atmosphere. Jet water (water jet) 7 is applied to the falling molten metal stream 8 through nozzles 6 attached to a nozzle header 5, whereby the molten metal stream 8 is divided into a metal powder 8*a*. The divided metal powder 8*a* in a molten state is then solidified by cooling using a water jet (cooling water). In this operation, the temperature of cooling water (water jet) is increased by the sensible heat of dissolution and the latent heat of solidification. Therefore, the temperature (MHF point) at which the transition from film boiling state to transition boiling state occurs is reduced and the cooling time in a film boiling state is elongated. Thus, a reduction in cooling rate is caused and the cooling rate necessary to amorphize a metal powder cannot be achieved.

Therefore, in order to achieve the above object, the inventors have intensively investigated various factors affecting the MHF point in cooling using jet water. As a result, the inventors have found that the influence of the temperature and ejection pressure of cooling water is significant.

First, results of basic experiments carried out by the inventors are described.

A base material used was a SUS304 steel plate (a size of 20 mm in thickness×150 mm in width×150 mm in length). A thermocouple was inserted into the base material from the back surface thereof such that the temperature of a position (lateral center, longitudinal center) 1 mm in depth from the front surface thereof could be measured. The base material was introduced into an oxygen-free furnace and was heated to 1,200° C. or higher. The heated base material was taken out. Immediately, cooling water was applied to the base material from cooling nozzle for atomization in such a manner that the amount and ejection pressure of cooling water were varied, followed by measuring the change in temperature of the position 1 mm in depth from the front surface. The cooling capacity during cooling was estimated by calculation from obtained temperature data. A boiling curve was prepared from the obtained cooling capacity. The point at which the cooling capacity increases sharply was judged to be the point of transition from film boiling to transition boiling, whereby the MHF point was determined.

Obtained results are shown in FIG. 1.

As is clear from FIG. 1, in the case where cooling water, used in a usual water atomization method, having a temperature of 30° C. is ejected at an ejection pressure of 1 MPa, the MHF point is about 700° C. in such a state that the cooling water is ejected. However, in the case where cooling water having a temperature of 10° C. or lower is ejected at an ejection pressure of 5 MPa or higher, the MHF point is 1,000° C. or higher in such a state that the cooling water is ejected. That is, the inventors have found that reducing the temperature (water temperature) of cooling water to 10° C. or lower and increasing the ejection pressure thereof to 5

MPa or higher increase the MHF point and increase the temperature of transition from film boiling to transition boiling to 1,000° C. or higher.

In usual, a metal powder obtained by atomizing molten metal has a surface temperature of about 1,000° C. to 1,300° C. Starting cooling with water-jet cooling with cooling capacity having an MHF point not higher than the surface temperature of the metal powder results in cooling in a film boiling region with low cooling capacity at the start of cooling. Therefore, if cooling is started with water-jet cooling having the MHF point higher than the surface temperature of a metal powder including a molten state, then the cooling of the metal powder can be started at least from a transition boiling region and cooling is promoted as compared to that in the film boiling region, thereby enabling the cooling rate of the metal powder to be significantly increased.

However, in the usual water atomization method, the temperature of cooling water (water jet) injected into a molten metal stream is increased and therefore desired rapid cooling necessary to amorphize a metal powder cannot be achieved. Therefore, the inventors have appreciated that, in addition to cooling (primary cooling) in which a molten metal stream is divided and cooled by applying a water jet (jet water) to the molten metal stream, a divided metal powder is secondarily cooled.

The inventors have found that, as secondary cooling, it is effective that fresh cooling water, preferably cooling water with an ejection pressure of 5 MPa or higher and a temperature of 10° C. or lower is further supplied to a metal powder, divided by primary cooling, including a molten state. Furthermore, the inventors have found that it is efficient that secondary cooling is performed from a temperature range where the surface temperature of the metal powder including the molten state is not lower than the cooling start temperature necessary for amorphization nor higher than the MHF point of secondary cooling.

The inventors have found that the MHF point of secondary cooling is increased and cooling capacity is increased in such a manner that a divided, cooled (primarily cooled) metal powder including a molten state is stored in a container together with cooling water and is secondarily cooled. Experiment results underlying this finding are described below.

A base material used was a SUS304 steel plate (a size of 20 mm in thickness×150 mm in width×150 mm in length). A thermocouple was inserted into the base material from the back surface thereof such that the temperature of a position (lateral center, longitudinal center) 1 mm in depth from the front surface thereof could be measured. The base material was introduced into an oxygen-free furnace and was heated to 1,200° C. or higher. The heated base material was taken out. A frame (a width of 148 mm×a length of 148 mm×a height of 50 mm) was placed on the base material such that the base material and the frame formed a container storing cooling water. Immediately, cooling water was applied to the base material from cooling nozzle for atomization in such a manner that the temperature and ejection pressure of water were varied, followed by measuring the change in temperature of the position 1 mm in depth from the front surface. The cooling capacity during cooling was estimated by calculation from obtained temperature data. A boiling curve was prepared from the obtained cooling capacity. The point at which the cooling capacity increases sharply was judged to be the point of transition from film boiling to transition boiling, whereby the MHF point was determined.

Obtained results are shown in FIG. 2. Incidentally, the case with no frame in FIG. 1 is shown together in FIG. 2.

As is clear from FIG. 2, placing the frame on the base material (steel plate) to form the container (with a frame) increases the MHF point as compared to the case with no frame. From FIG. 2, the inventors have found that the increase of the MHF point is significant when the water temperature is 30° C. or lower. This is probably because cooling water in the container is stirred by forming the container (with a frame), a steam film is likely to be removed by a stream along a cooled surface, and therefore the cooling capacity is increased. This is also probably because shock waves generated when water collides with the surface of a water pool at high speed facilitate the transition from film boiling to transition boiling to increase the cooling capacity.

Considering that the influence of such shock waves is effective, the inventors have further found that cooling with high cooling capacity is similarly achieved by providing a collision plate serving as a secondary cooling means on a path where molten metal divided into powder by a water atomization method or a metal powder falls together with cooling water.

The inventors have found that cooling a metal powder by such a cooling method with high cooling capacity enables quenching, essential to amorphize the metal powder, in a crystallization temperature range to be readily achieved.

Embodiments of the present invention include:

(1) A method for producing a water-atomized metal powder includes applying water to a molten metal stream, dividing the molten metal stream into a metal powder, and cooling the metal powder. The metal powder is further subjected to secondary cooling with cooling capacity having a minimum heat flux point (MHF point) higher than the surface temperature of the metal powder in addition to the cooling. The secondary cooling is performed from a temperature range where the temperature of the metal powder after the cooling is not lower than the cooling start temperature necessary for amorphization nor higher than the minimum heat flux point (MHF point).

(2) In the method for producing the water-atomized metal powder specified in Item (1), the secondary cooling is cooling in which water ejection is performed using water different from water used to divide the molten metal stream.

(3) In the method for producing the water-atomized metal powder specified in Item (2), the cooling in which water ejection is performed is cooling in which jet water with a temperature of 10° C. or lower and an ejection pressure of 5 MPa or higher is used.

(4) In the method for producing the water-atomized metal powder specified in Item (1), the secondary cooling is cooling by using a container placed on the fall path of cooling water after the cooling, divided molten metal falling together with the cooling water, and the metal powder.

(5) In the method for producing the water-atomized metal powder specified in Item (1), the secondary cooling is cooling by a collision plate placed on the fall path of cooling water after the cooling, divided molten metal falling together with the cooling water, and the metal powder.

(6) In the method for producing the water-atomized metal powder specified in Item (4) or (5), the cooling is such that water with a temperature of 30° C. or lower or water with a temperature of 30° C. or lower and an ejection pressure of 5 MPa or higher is ejected, the molten metal stream is divided into the metal powder, and the metal powder is cooled.

(7 ) In the method for producing the water-atomized metal powder specified in any one of Items (1) to (6), the molten metal is composed of an Fe—B alloy or an Fe—Si—B alloy and the water-atomized metal powder is powder containing 90% or more of an amorphous metal powder.

According to embodiments of the present invention, a metal powder can be rapidly cooled at $10^5$ K/s or more by a simple method. This allows an amorphous water-atomized metal powder advantageous in producing a dust core to be readily produced, enables a metal powder for dust cores with low iron loss to be readily produced, and further enables a metal powder to be produced at low cost, thereby providing industrially remarkable effects. According to embodiments of the present invention, there is also an effect that a dust core having a complicated shape and low iron loss is readily produced. Furthermore, there is an effect that a water-atomized powder is more suitable for producing a dust core than a gas-atomized powder because the water-atomized powder is unlikely to be spherical.

The critical cooling rate for amorphization of an Fe—B alloy ($Fe_{83}B_{17}$) is $1.0\times10^6$ K/s and that of an Fe—Si—B alloy ($Fe_{79}Si_{10}B_{11}$) is $1.8\times10^5$ K/s as exemplified, the Fe—B alloy and the Fe—Si—B alloy being typical amorphous alloys. According to embodiments of the present invention, there is an effect that the critical cooling rate for amorphization of such values is readily ensured.

DETAILED DESCRIPTION OF THE INVENTION

In embodiments of the present invention, first, a metal material that is a raw material is melted into molten metal. The metal material, which is used as a raw material, may be any of pure metals, alloys, pig iron, and the like conventionally used in the form of powder. The following materials can be exemplified: for example, pure iron; low-alloy steels; iron-based alloys such as stainless steel; non-ferrous metals such as Ni and Cr; non-ferrous alloys; and amorphous alloys (non-crystalline alloys) such as Fe—B alloys, Fe—Si—B alloys, and Fe—Ni—B alloys. Needless to say, the above-mentioned alloys may possibly contain an element other than the above-mentioned elements in the form of an impurity.

A method for melting the metal material need not be particularly limited and any of melting means, such as an electric furnace and a vacuum melting furnace, in common use can be used.

Figure 1:
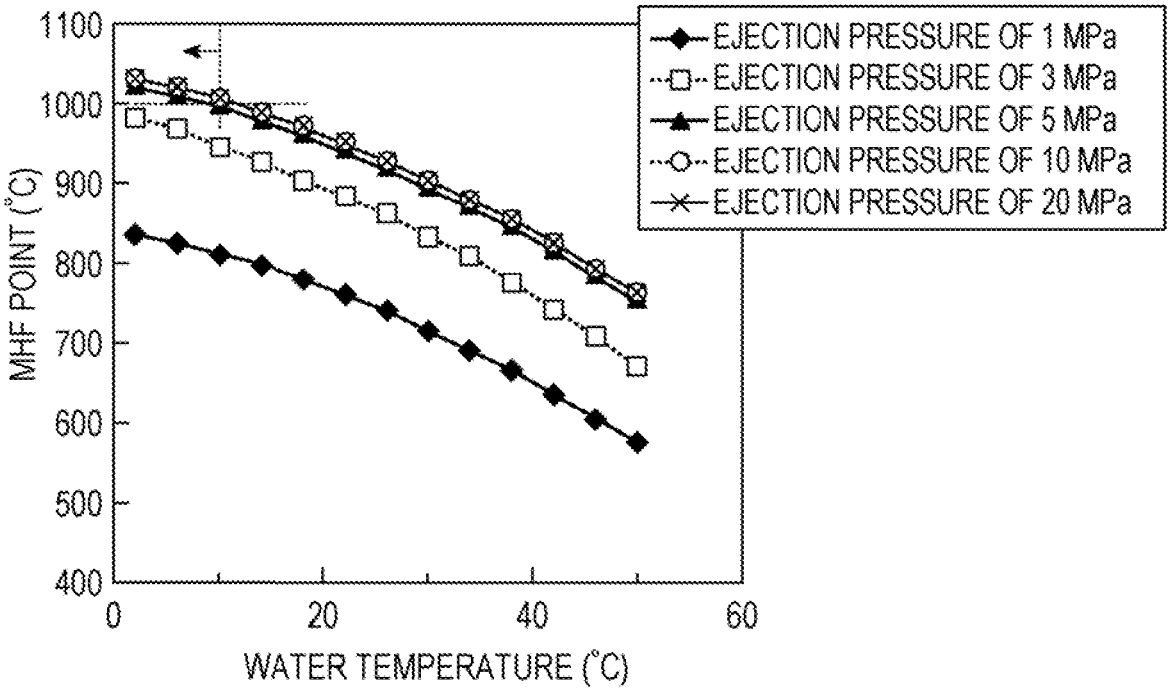
FIG. 1 is a graph showing the influence of the temperature and ejection pressure of cooling water on the MHF point.
Figure 2:
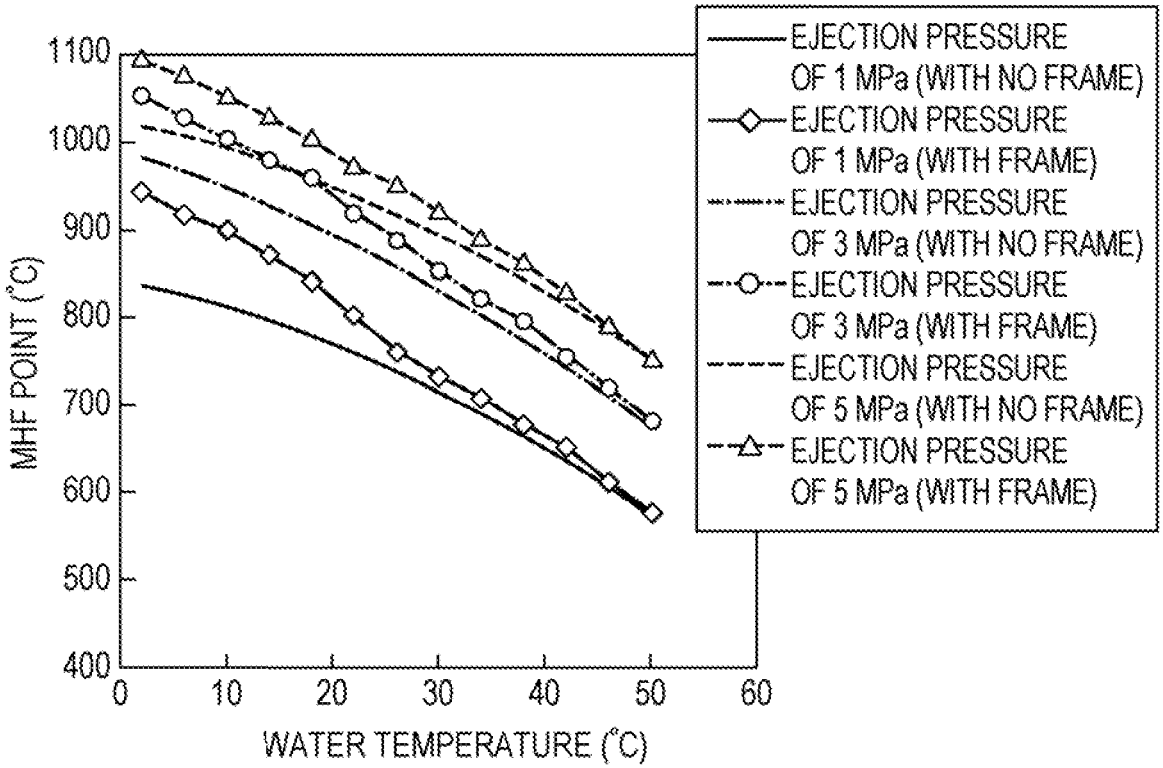
FIG. 2 is a graph showing the influence of a "frame" on the relationship between the temperature and ejection pressure of cooling water and the MHF point.
Figure 3:
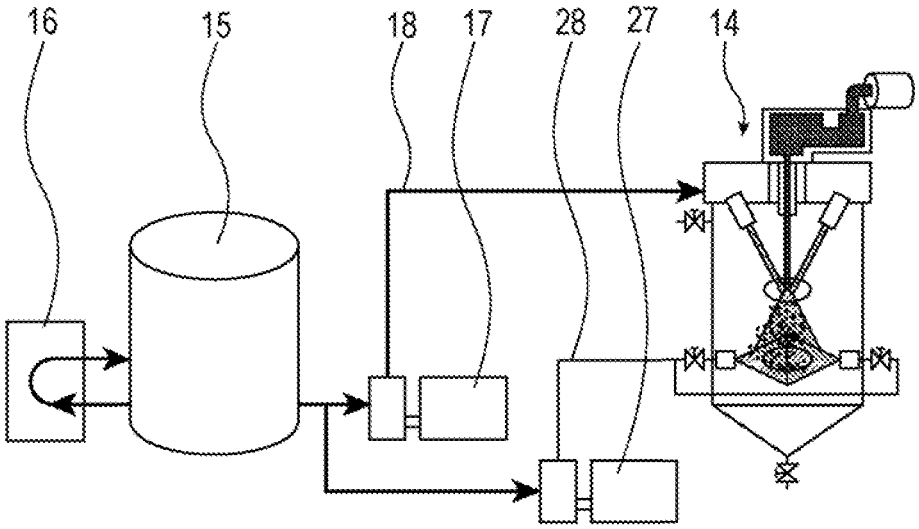
FIG. 3 is a schematic illustration showing an example of the schematic configuration of a water-atomized metal powder production apparatus for carrying out embodiments of the present invention.
Figure 3:
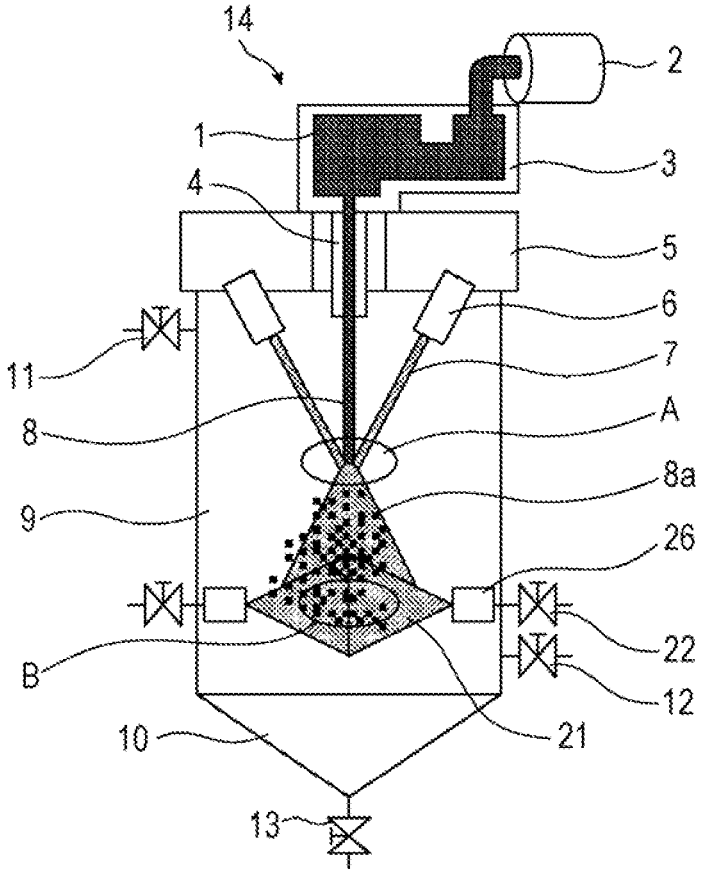

The molten metal is transferred to a container such as a tundish from a melting furnace and is then processed into a water-atomized metal powder in a water-atomized metal powder production apparatus. FIG. 3 shows an example of a preferable water-atomized metal powder production apparatus used in embodiments of the present invention.

An embodiment of the present invention, which uses a water atomization method, is described with reference to FIG. 3. FIG. 3(*a*) shows the configuration of an entire plant. FIG. 3(*b*) shows details of a water-atomized metal powder production apparatus 14.

Molten metal 1 is dropped into a chamber 9 from a container such as a tundish 3 through a molten metal guide nozzle 4 in the form of a molten metal stream 8. Needless to say, an inert gas valve 11 is opened such that the chamber 9 has an inert gas atmosphere. A nitrogen gas and an argon gas can be exemplified as the inert gas.

Jet water (water jet) 7 is applied to the falling molten metal stream 8 through nozzles 6 attached to a nozzle header 5 such that the molten metal stream 8 is divided, followed by cooling, whereby a metal powder 8*a* is obtained. A position A where the molten metal stream 8 and the jet water (water jet) 7 are brought into contact with each other is preferably a position apart from the molten metal guide nozzle 4 at an appropriate distance from the viewpoint that the molten metal stream 8 is cooled to near the melting point by heat radiation and the cooling action of the inert gas and the viewpoint that splashes of the jet water 7 are prevented from coming into contact with the molten metal guide nozzle 4.

In embodiments of the present invention, the ejection pressure or temperature of the jet water (water jet) 7, which is used to divide the molten metal stream 8, is not particularly limited as far as the jet water (water jet) 7 may have an ejection pressure sufficient to divide the molten metal stream 8. The jet water (water jet) 7 preferably has a temperature of 30° C. or lower or has a temperature of 30° C. or lower and an ejection pressure of 5 MPa or higher. In particular, when the water temperature is higher than 20° C., the cooling rate of a metal powder is low and therefore the metal powder cannot be maintained in an amorphous state even when applying a secondary cooling. The water temperature is preferably 10° C. or lower and more preferably 5° C. or lower.

In the production of the metal powder by water atomization in embodiments of the present invention, the jet water 7 is applied to the molten metal stream 8 at the position A as described above, whereby the molten metal stream is divided and the divided metal powder (including those in a molten state) 8*a* is cooled (primarily cooled). Furthermore, the metal powder (including those in a molten state) 8*a* is secondarily cooled at a position B apart from the position A at an appropriate distance.

Secondary cooling is preferably performed in such a manner that cooling jet water 21 is ejected as shown in FIG. 3(*b*). The temperature or ejection pressure of the cooling jet water 21, which is used for secondary cooling, is not particularly limited. In order to achieve cooling to a transition boiling state or cooling to a nucleate boiling state, cooling water with a temperature of 10° C. or lower is preferably turned into cooling water with an ejection pressure of 5 MPa or higher such that the MHF point is higher than 1,000° C. The ejection angle of the cooling jet water 21 is preferably set to 5° to 45° such that the cooling jet water 21 can be uniformly applied to the metal powder falling together with primary cooling water. Furthermore, the falling metal powder is preferably cooled from substantially all directions by arranging about two to eight nozzles 26 for performing secondary cooling. The cooling jet water 21 used may be in a system of water that is different from one in which the jet water for dividing the molten metal stream 8 is used.

When the temperature (water temperature) of the cooling jet water 21 for secondary cooling is higher than 10° C., the MHF point is low and a desired cooling rate can hardly be ensured. Therefore, the temperature (water temperature) of the cooling jet water 21 for secondary cooling is preferably limited to 10° C. or lower. The temperature thereof is more preferably 8° C. or lower. When the ejection pressure of the cooling jet water 21 for secondary cooling is lower than 5 MPa, cooling cannot be performed such that the MHF point is a desired temperature, even if the temperature of cooling water is 10° C. or lower. Thus, a desired cooling rate can hardly be ensured. Therefore, the ejection pressure of the cooling jet water 21 is preferably limited to 5 MPa or higher. Even if the ejection pressure of the cooling jet water 21 is increased to higher than 10 MPa, the increase of the MHF point is saturated. Therefore, the ejection pressure thereof is preferably set to 10 MPa or lower.

The term "desired cooling rate" as used herein refers to the minimum cooling rate at which amorphization can be achieved, that is, an average cooling rate of about $10^5$ K/s to $10^6$ K/s in a cooling temperature range necessary to prevent crystallization.

The term "cooling temperature range necessary to prevent crystallization" as used herein refers to a range from the cooling start temperature necessary for amorphization to a first crystallization temperature (for example, 400° C. to 600° C.) that is a cooling stop temperature. The cooling start temperature necessary for amorphization varies depending on the composition of molten metal and may be, for example, 900° C. to 1,100° C.

Secondary cooling is preferably performed from a temperature range where the temperature of the cooled (primarily cooled) metal powder is not lower than the cooling start temperature necessary for amorphization nor higher than the MHF point of secondary cooling. When the temperature of the cooled metal powder is higher than the MHF point of secondary cooling, secondary cooling cannot be set to cooling in a transition boiling state or cooling in a nucleate boiling state and therefore, the desired cooling rate can hardly be ensured. When the temperature of the cooled metal powder is lower than the cooling start temperature necessary for amorphization, the temperature of the metal powder is too low to ensure the desired cooling rate and crystallization is likely to proceed.

It is preferable that cooling water used for the jet water 7 is cooled to low temperature in advance with a heat exchanger such as a chiller 16 which can cool cooling water to a low temperature and is stored in a cooling water tank 15 (heat-insulating structure) placed outside the water-atomized metal powder production apparatus 14. In a usual cooling water production apparatus, it is difficult to produce cooling water at 3° C. to lower than 4° C. because the inside of a heat exchanger is frozen. Therefore, a mechanism for supplying ice to the tank from an ice-making machine may be used. Needless to say, the cooling water tank 15 is further provided with a high-pressure pump 17 which is a pump for pressurizing and delivering the cooling water used for the jet water 7 and a pipe 18 for supplying the cooling water to the nozzle header 5 from the high-pressure pump.

Cooling water used for the cooling jet water 21, as well as the cooling water used for the jet water 7, is preferably stored in the cooling water tank 15 (heat-insulating structure), which is placed outside the water-atomized metal powder production apparatus 14, in advance. Needless to say, the cooling water tank 15 is provided with a high-pressure pump 27 for pressurizing and delivering the cooling water used for the cooling jet water 21 separately from the cooling water used for the jet water 7 and a pipe 28 for supplying the cooling water to the nozzles 26 for secondary cooling from the high-pressure pump 27. Incidentally, a surge tank, a switching valve, or the like may be placed between pipes such that high-pressure water is readily ejected suddenly.

Secondary cooling is preferably set such that the divided metal powder 8*a* can be cooled to a transition boiling state or a nucleate boiling state. Therefore, the start position of secondary cooling (the position B: the position of a nozzle for secondary cooling) is preferably set such that the surface temperature of the water-atomized metal powder 8*a* is not lower than the cooling start temperature necessary to prevent crystallization nor higher than the MHF point of secondary cooling. The surface temperature of the metal powder 8*a* can be adjusted by varying the distance between the atomization position A and the cooling start position of secondary cooling (the position B). Therefore, the nozzles 26 for secondary cooling are preferably arranged to be vertically movable.

Figure 4:
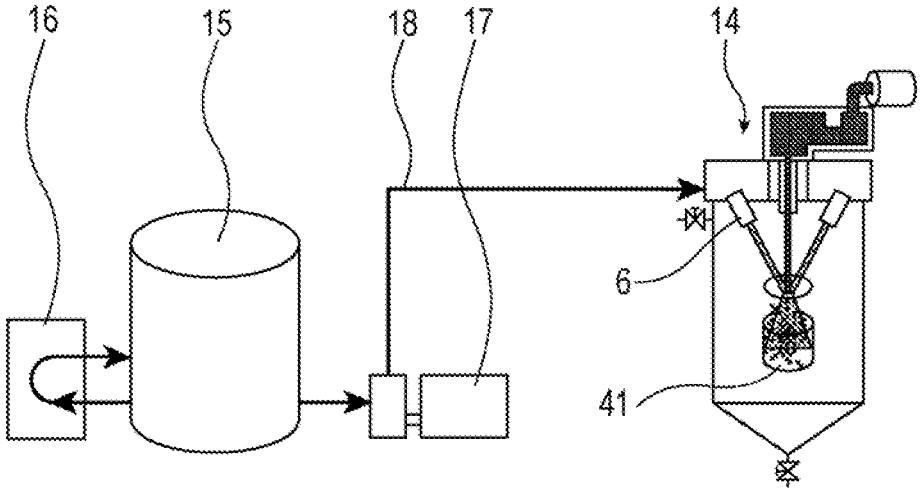
FIG. 4 is a schematic illustration showing an example of the schematic configuration of a water-atomized metal powder production apparatus for carrying out embodiments of the present invention.
Figure 4:
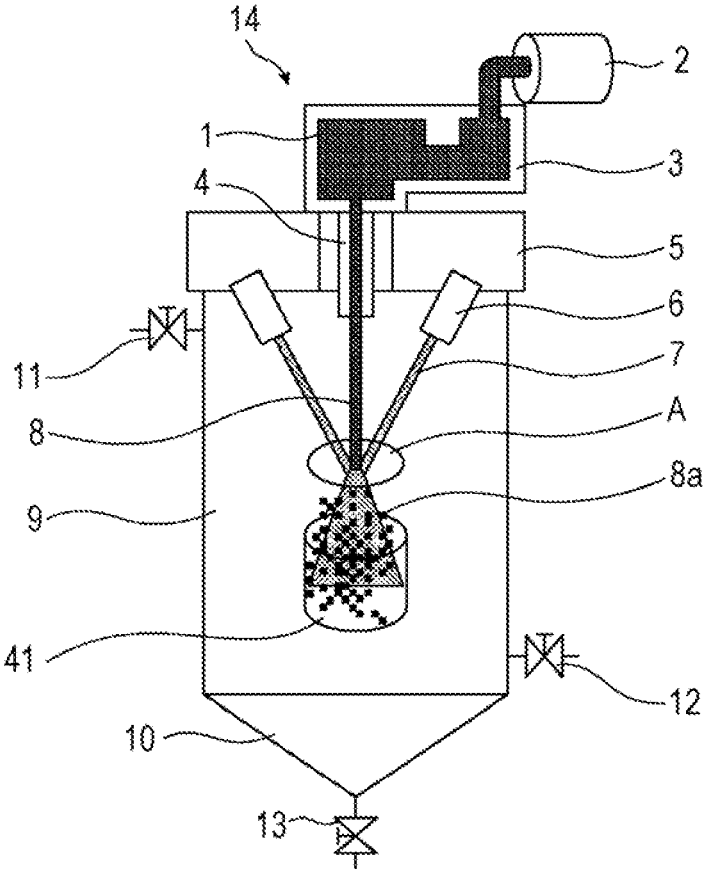

Secondary cooling is preferably cooling by using a container 41 placed downstream of the position A instead of cooling by the cooling jet water. An example of the water-atomized metal powder production apparatus in this case is shown in FIG. 4. FIG. 4(*a*) shows the whole of a plant. FIG. 4(*b*) shows details of the water-atomized metal powder production apparatus 14.

The container 41 is placed at the position B, which is in the fall path of cooling water (atomizing cooling water) used to divide the molten metal stream 8 and subsequently used to cool the metal powder, the divided molten metal, and the metal powder in cooling and which is downstream of the position A. The position B is a position where the surface temperature of the metal powder 8*a* is not lower than the cooling start temperature necessary to prevent crystallization nor higher than the MHF point, that is, a secondary cooling start position. Since the container 41 is placed at the position B (preferably such that the position of the bottom surface of the container corresponds to the position B), cooling water is stored in the container to form a water pool and is stirred in the container and a steam film on the surface of the metal powder is likely to be removed by a stream along the surface of the metal powder stored at the same time. It is conceivable that shock waves generated when water collides with the surface of the water pool formed in the container at high speed facilitate the transition from film boiling to transition boiling.

The placed container 41 preferably has a size sufficient to store cooling water (atomizing cooling water used to divide the molten metal stream 8 and subsequently used to cool the metal powder, the divided molten metal, and/or the metal powder. When the container is too large, a shock wave is unlikely to be generated. When the flow rate of atomizing cooling water is about 200 L/min, a container having an inside diameter of about 50 mm to 150 mm and a depth of about 30 mm to 100 mm is enough. The container is preferably made of metal in terms of strength and may be made of ceramic.

Figure 5:
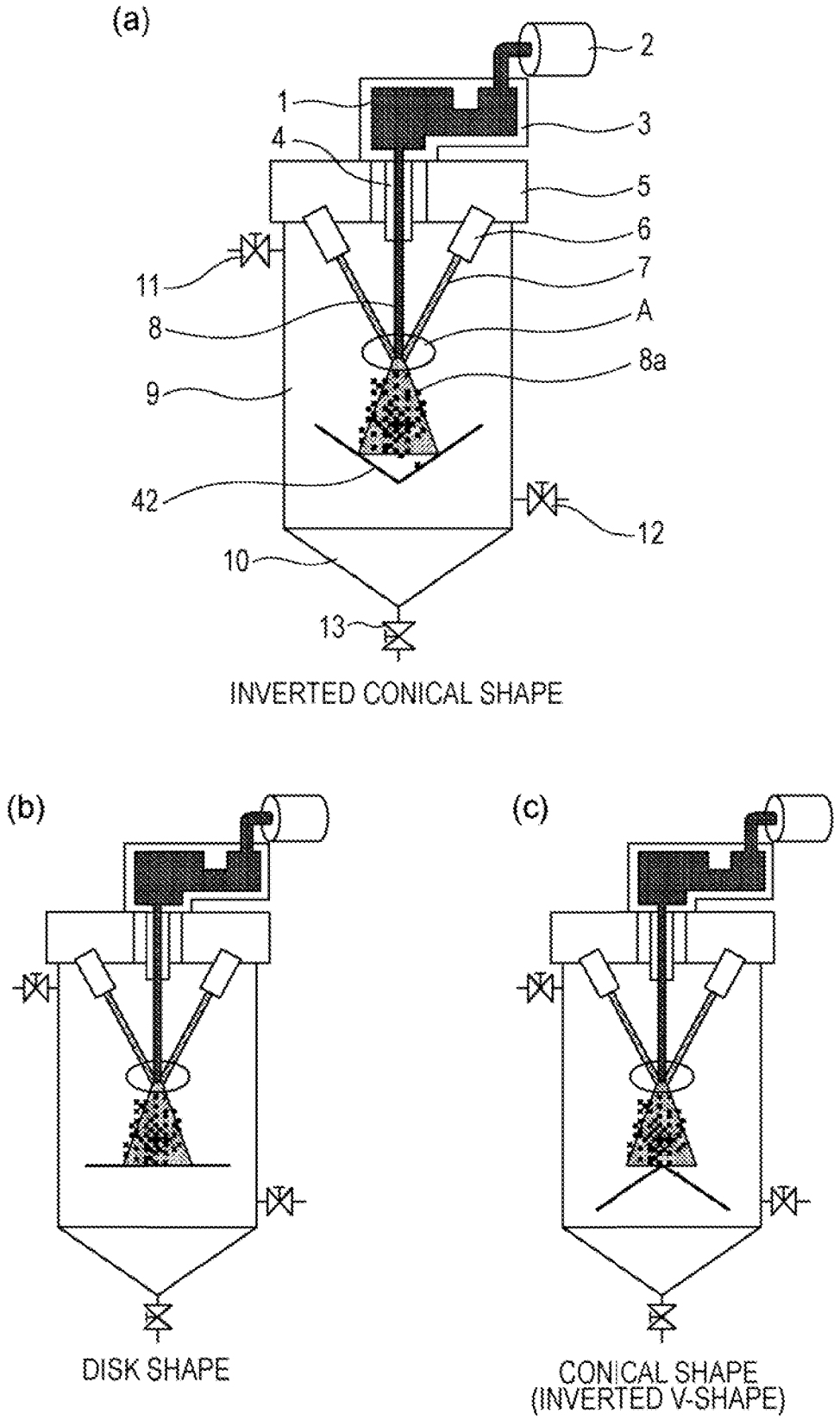
FIG. 5 is a schematic illustration showing an example of the schematic configuration of a water-atomized metal powder production apparatus for carrying out embodiments of the present invention.
Figure 6:
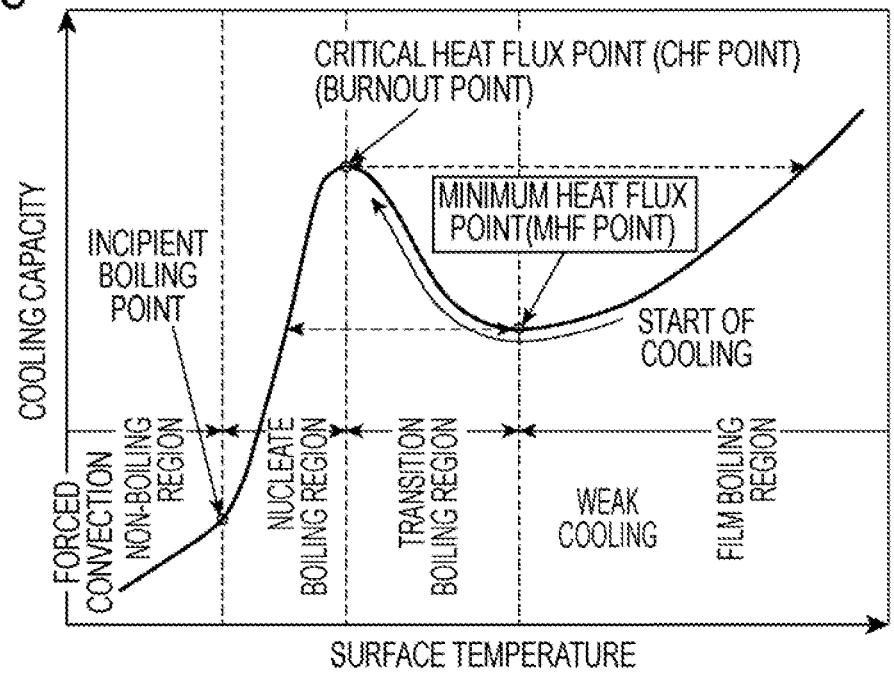
FIG. 6 is a schematic illustration showing the outline of a boiling curve.
Figure 7:
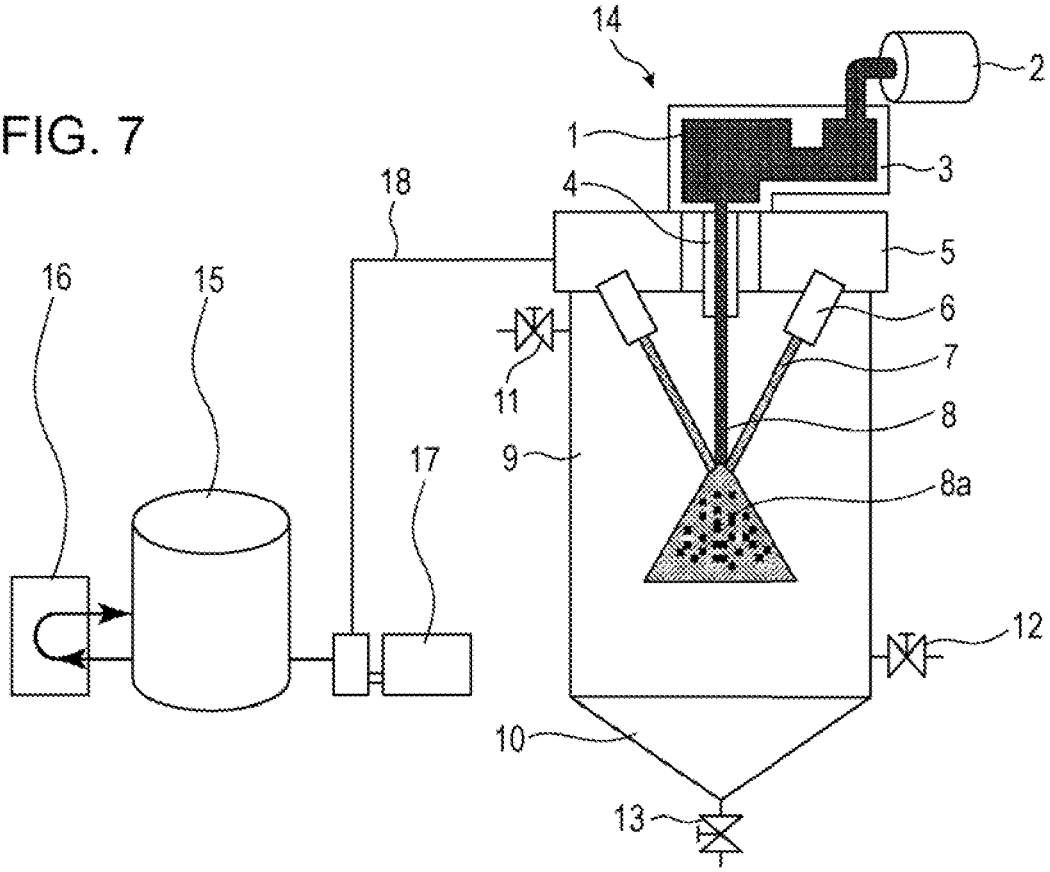
FIG. 7 is a schematic illustration showing the schematic configuration of a conventional water-atomized metal powder production apparatus.

Secondary cooling may be cooling performed by placing a collision plate 42 instead of cooling performed by placing the container 41. An example of the water-atomized metal powder production apparatus in this case is shown in FIG. 5. FIG. 5(*a*) shows the case where the collision plate 42 has an inverted conical shape, FIG. 5(*b*) shows the case where the collision plate 42 has a disk shape, and FIG. 5(*c*) shows the case where the collision plate 42 has a conical shape.

The collision plate 42, as well as the container 41, is placed at the secondary cooling start position (the position B), which is in the fall path of atomizing cooling water, the divided molten metal, and the metal powder and which is downstream of the position A. Since the collision plate 42 is placed at such a position, the metal powder is likely to be shifted from a film boiling state to a transition boiling state by shock waves generated when atomizing cooling water and the metal powder collide with the collision plate 42; hence, cooling with high cooling capacity is similarly achieved.

The collision plate 42 has only to be capable of blocking the fall path of atomizing cooling water, the molten metal, and the metal powder in cooling. The shape thereof is not particularly limited and may probably be a disk shape, a conical shape, an inverted conical shape, or the like. Since a shape capable of forming a surface perpendicular to the fall path is effective in generating a shock wave, an inverted conical shape (FIG. 5(*c*)) is preferably avoided.

The present invention is further described below with reference to examples.

EXAMPLES

Example 1

Each metal powder was produced using a water-atomized metal powder production apparatus shown in FIG. 3.

Raw materials were blended (partly containing impurities is inevitable) such that an Fe—B alloy ($Fe_{83}B_{17}$) with a composition of 83% Fe-17% B and an Fe—Si—B alloy ($Fe_{79}Si_{10}B_{11}$) with a composition of 79% Fe-10% Si-11% B on an atomic basis were obtained, followed by melting the raw materials at about 1,550° C. in a melting furnace 2, whereby about 50 kgf of each molten metal was obtained. The obtained molten metal 1 was slowly cooled to 1,350° C. in the melting furnace 2 and was then poured into a tundish 3. An inert gas valve 11 was opened in advance such that a chamber 9 had a nitrogen gas atmosphere. Before the molten metal was poured into the tundish 3, cooling water was supplied to a nozzle header 5 from a cooling water tank 15 (a volume of 10 $m^3$) by operating a high-pressure pump 17, whereby jet water (fluid) 7 was ejected from water ejection nozzles 6. Furthermore, cooling water was supplied to nozzles 26 for secondary cooling from the cooling water tank 15 (a volume of 10 $m^3$) in such a manner that a high-pressure pump 27 for secondary cooling water was operated and valves 22 for secondary cooling water were opened, whereby cooling jet water 21 was ejected.

A position A where a molten metal stream 8 was in contact with the jet water 7 was set to a position 80 mm apart from a molten metal guide nozzle 4. The nozzles 26 for secondary cooling were placed at a position B. The position B was set to each position 100 mm to 800 mm apart from the position A. The ejection pressure of the jet water 7 was set to 1 MPa or 5 MPa and the temperature thereof was set to 30° C. (±2° C.) or 8° C. (±2° C.). The ejection pressure of the cooling jet water 21 used for secondary cooling was set to 5 MPa and the temperature thereof was set to 20° C. (±2° C.) or 8° C. (±2° C.). The water temperature was adjusted with a chiller 16 placed outside the cooling water tank 15.

The molten metal 1 poured into the tundish 3 was dropped into the chamber 9 through the molten metal guide nozzle 4 to form the molten metal stream 8, which was brought into contact with the jet water (fluid) 7 in such a manner that the temperature and ejection pressure of the jet water (fluid) 7 were varied as shown in Table 1, whereby the molten metal stream 8 was divided into a metal powder. The metal powder was cooled while being mixed with cooling water, was further secondarily cooled with the cooling jet water 21 ejected from the nozzles 26 for secondary cooling, and was collected from a collection port 13. Incidentally, an example in which no secondary cooling was performed was a comparative example. The surface temperature of the metal powder before secondary cooling was estimated from results of a separately performed primary cooling experiment. The MHF point of secondary cooling was estimated from a separately performed experiment and was listed in the table.

After contaminants other than the obtained metal powder were removed, an amorphous halo peak and a crystalline diffraction peak of the metal powder were measured by X-ray diffractometry. The degree of crystallinity was determined from the ratio between the integrated intensity of a diffracted X-ray from the amorphous halo peak and that from the crystalline diffraction peak. The percentage of amorphousness (the degree of amorphousness: %) was calculated from (1−the degree of crystallinity). The case where the degree of amorphousness (the degree of amorphization) was 90% or more was rated "A" and others were rated "B".

Obtained results are shown in Table 1.

TABLE 1

| | | Dividing-cooling (primary cooling) Water injection conditions | | Secondary cooling | | | | | | | | |
|---|---|---|---|---|---|---|---|---|---|---|---|---|
| | | | | | | | Water injection conditions | | | | | |
| Powder No. | Composition | Ejection pressure (MPa) | Water temperature (° C.) | Cooling start temperature (° C.) | Cooling means | Installation position B*** (mm) | Ejection pressure (MPa) | Water temperature (° C.) | MHF point (° C.) | Degree of amorphization (%) | Evaluation | Remarks |
| 1 | $Fe_{79}Si_{10}B_{11}$* | 5 | 30 | — | — | — | — | — | — | 28 | B | Comparative example |
| 2 | | 5 | 8 | — | — | — | — | — | — | 36 | B | Comparative example |
| 3 | | 5 | 30 | 955 | Water injection | 300 | 5 | 20 | 960 | 93 | A | Inventive example |
| 4 | | 1 | 8 | 958 | Water injection | 300 | 5 | 8 | 1010 | 95 | A | Inventive example |
| 5 | $Fe_{83}B_{17}$** | 5 | 8 | 984 | Water injection | 300 | 5 | 8 | 1010 | 96 | A | Inventive example |
| 6 | | 5 | 8 | 953 | Water injection | 300 | 5 | 20 | 960 | 90 | A | Inventive example |
| 7 | | 1 | 8 | 1005 | Water injection | 300 | 5 | 8 | 1010 | 91 | A | Inventive example |

TABLE 1-continued

| Powder No. | Composition | Dividing-cooling (primary cooling) Water injection conditions: Ejection pressure (MPa) | Water temperature (° C.) | Secondary cooling: Cooling start temperature (° C.) | Cooling means | Installation position B*** (mm) | Water injection conditions: Ejection pressure (MPa) | Water temperature (° C.) | MHF point (° C.) | Degree of amorphization (%) | Evaluation | Remarks |
|---|---|---|---|---|---|---|---|---|---|---|---|---|
| 8 | | 5 | 8 | 1008 | Water injection | 100 | 5 | 8 | 1010 | 90 | A | Inventive example |
| 9 | | 5 | 8 | 998 | Water injection | 200 | 5 | 8 | 1010 | 92 | A | Inventive example |
| 10 | | 5 | 8 | 973 | Water injection | 400 | 5 | 8 | 1010 | 93 | A | Inventive example |
| 11 | | 5 | 8 | 920 | Water injection | 800 | 5 | 8 | 1010 | 88 | B | Comparative example |

*The cooling rate necessary for amorphization is $1.8 \times 10^5$ K/s and the cooling start temperature necessary for amorphization is 950° C.
**The cooling rate necessary for amorphization is $1.0 \times 10^6$ K/s and the cooling start temperature necessary for amorphization is 970° C.
***The distance from a water atomization position A (vertical direction).

In every inventive example, the degree of amorphousness of a water-atomized metal powder is 90% or more. This shows that in embodiments of the present invention, a cooling rate of $1.8\times10^5$ K/s to $1.0\times10^6$ K/s or more, which is the critical cooling rate for amorphization, is obtained. However, in comparative examples (Powders No. 1 and No. 2) in which no secondary cooling was performed, the degree of amorphousness is less than 90%.

In some of inventive examples, the degree of amorphousness is slightly low. In Powders No. 3 and No. 6, the temperature of cooling jet water for secondary cooling is high. In Powder No. 7 , the ejection pressure of jet water for dividing a molten metal stream is lower than a preferable scope. In Powders No. 8 and No. 9, the cooling start position of secondary cooling is close to the position A; hence, the cooling start temperature of secondary cooling is close to the MHF point and the degree of amorphousness is slightly low though the degree of amorphousness is 90% or more. In Powder No. 10, the cooling start position of secondary cooling is far apart from the position A; hence, the time until the start of secondary cooling is long, cooling is slow because the surface temperature of the powder is too low, and the degree of amorphousness is slightly low though the degree of amorphousness is 90% or more. In Powder No. 11, the secondary cooling start position (position B) is too far apart from the position A, the temperature of the metal powder is lower than a necessary cooling start temperature, and it is conceivable that crystallization proceeded.

Example 2

Each metal powder was produced using a water-atomized metal powder production apparatus shown in FIG. 4.

Raw materials were blended (partly containing impurities is inevitable) such that an Fe—B alloy ($Fe_{83}B_{17}$) with a composition of 83% Fe-17% B and an Fe—Si—B alloy ($Fe_{79}Si_{10}B_{11}$) with a composition of 79% Fe-10% Si-11% B on an atomic basis were obtained, followed by melting the raw materials at about 1,550° C. in a melting furnace 2, whereby about 50 kgf of each molten metal was obtained. The obtained molten metal 1 was slowly cooled to 1,350° C. in the melting furnace 2 and was then poured into a tundish 3. An inert gas valve 11 was opened in advance such that a chamber 9 had a nitrogen gas atmosphere. Before the molten metal was poured into the tundish 3, cooling water was supplied to a nozzle header 5 from a cooling water tank 15 (a volume of 10 $m^3$) by operating a high-pressure pump 17, whereby jet water (fluid) 7 was ejected from water ejection nozzles 6. A container 41 made of metal was placed on the fall path of cooling water and a metal powder, the fall path being downstream of a position A, such that cooling water and the divided metal powder were stored therein after water atomization. The container 41 made of metal had a size of 100 mm in outside diameter×90 mm in inside diameter×40 mm in depth.

The position A where a molten metal stream 8 was in contact with the jet water 7 was set to a position 80 mm apart from a molten metal guide nozzle 4. The container 41 for secondary cooling was placed at a position B. The position B was set to each position (the position of the bottom of a container) 100 mm to 800 mm apart from the position A. The ejection pressure of the jet water 7 was set to 3 MPa or 5 MPa and the temperature thereof was set to 40° C. (±2° C.) or 20° C. (±2° C.). The water temperature was adjusted with a chiller 16 placed outside the cooling water tank 15.

The molten metal 1 poured into the tundish 3 was dropped into the chamber 9 through the molten metal guide nozzle 4 to form the molten metal stream 8, which was brought into contact with the jet water 7 in such a manner that the temperature and ejection pressure of the jet water (fluid) 7 were varied as shown in Table 2, whereby the molten metal stream 8 was divided into a metal powder. The divided metal powder was mixed with cooling water, fell while being cooled, was stored in the container 41, was stirred in the container 41 together with cooling water, was cooled, and was collected from a collection port 13. The metal powder stored in the container was exposed to shock waves generated when falling cooling water collided with the surface of a water pool in the container at high speed. Incidentally, an example in which no secondary cooling was performed was a comparative example. The surface temperature of the metal powder before secondary cooling and the MHF point of secondary cooling were estimated in substantially the same manner as that used in (Example 1) and were listed together in the table.

After contaminants other than the obtained metal powder were removed, an amorphous halo peak and a crystalline diffraction peak of the metal powder were measured by X-ray diffractometry. The degree of crystallinity was determined from the ratio between the integrated intensity of a diffracted X-ray from the amorphous halo peak and that from the crystalline diffraction peak in substantially the same manner as that used in Example 1. The percentage of amorphousness (the degree of amorphousness: %) was calculated from (1−the degree of crystallinity). The case where the degree of amorphousness was 90% or more was rated "A" and the case where the degree of amorphousness was less than 90% was rated "B" in substantially the same manner.

Obtained results are shown in Table 2.

TABLE 2

| Powder | | Dividing-cooling (primary cooling) Water injection conditions | | Secondary cooling | | | | | | |
|---|---|---|---|---|---|---|---|---|---|---|
| | | Ejection pressure | Water temperature | Cooling start temperature | Cooling | Installation position B*** | MHF point | Degree of amorphization | | |
| No. | Composition | (MPa) | (° C.) | (° C.) | means | (mm) | (° C.) | (%) | Evaluation | Remarks |
| 2-1 | $Fe_{79}Si_{10}B_{11}$* | 3 | 20 | — | — | — | — | 56 | B | Comparative example |
| 2-2 | | 3 | 20 | 963 | Container | 300 | 970 | 96 | A | Inventive example |
| 2-3 | | 3 | 40 | 982 | Container | 300 | 780 | 85 | B | Comparative example |
| 2-4 | | 3 | 20 | 968 | Container | 100 | 970 | 92 | A | Inventive example |
| 2-5 | | 3 | 20 | 951 | Container | 400 | 970 | 91 | A | Inventive example |
| 2-6 | | 3 | 20 | 922 | Container | 800 | 970 | 83 | B | Comparative example |
| 2-7 | $Fe_{83}B_{17}$** | 5 | 20 | — | — | — | — | 53 | B | Comparative example |
| 2-8 | | 5 | 20 | 983 | Container | 300 | 1003 | 94 | A | Inventive example |
| 2-9 | | 5 | 40 | 1025 | Container | 300 | 840 | 87 | B | Comparative example |
| 2-10 | | 5 | 20 | 998 | Container | 100 | 1003 | 93 | A | Inventive example |
| 2-11 | | 5 | 20 | 971 | Container | 400 | 1003 | 90 | A | Inventive example |
| 2-12 | | 5 | 20 | 911 | Container | 800 | 1003 | 84 | B | Comparative example |

*The cooing rate necessary for amorphization is $1.8 \times 10^5$ K/s and the cooling start temperature necessary for amorphization is 950° C.
**The cooling rate necessary for amorphization is $1.0 \times 10^6$ K/s and the cooling start temperature necessary for amorphization is 970° C.
***The distance from a water atomization position A (vertical direction).

In every inventive example, the degree of amorphousness of a water-atomized metal powder is 90% or more. However, in comparative examples (Powders No. 2-1 and No. 2-7 ) in which no secondary cooling was performed, the degree of amorphousness is less than 90%. Incidentally, in some of the inventive examples that are outside a preferable scope of embodiments of the present invention, the degree of amorphousness is slightly low.

In Powders No. 2-3 and No. 2-9, the temperature of jet water (primary cooling water) for dividing a molten metal stream is higher than the preferable scope, the secondary cooling start temperature is high, the time of cooling in a film boiling region is long, and the degree of amorphousness is low, less than 90%.

In Powders No. 2-4 and No. 2-10, the installation position of the container 41 is close to the position A, which is a position where a molten metal stream is divided, and therefore the cooling start temperature of secondary cooling is high; hence, the degree of amorphousness is slightly low though the degree of amorphousness is 90% or more.

In Powders No. 2-5 and No. 2-11, the installation position of the container 41 is far apart from the position A, which is a position where a molten metal stream is divided; hence, the time until the start of secondary cooling is long, the surface temperature of the metal powder is low, cooling is slow, and the degree of amorphousness is slightly low though the degree of amorphousness is 90% or more. In Powders No. 2-6 and No. 2-12, the secondary cooling start position (position B) is too far apart from the position A, the temperature of the metal powder is lower than a necessary cooling start temperature, crystallization proceeds, and the degree of amorphousness is less than 90%.

Example 3

Each metal powder was produced using a water-atomized metal powder production apparatus shown in FIG. 5.

Raw materials were blended (partly containing impurities is inevitable) such that an Fe—B alloy ($Fe_{83}B_{17}$) with a composition of 83% Fe-17% B and an Fe—Si—B alloy ($Fe_{79}Si_{10}B_{11}$) with a composition of 79% Fe-10% Si-11% B on an atomic basis were obtained, followed by melting the raw materials at about 1,550° C. in a melting furnace 2, whereby about 50 kgf of each molten metal was obtained. The obtained molten metal 1 was slowly cooled to 1,350° C. in the melting furnace 2 and was then poured into a tundish 3. An inert gas valve 11 was opened in advance such that a chamber 9 had a nitrogen gas atmosphere. Before the molten metal was poured into the tundish 3, cooling water was supplied to a nozzle header 5 from a cooling water tank (a volume of 10 $m^3$) by operating a high-pressure pump, whereby jet water (fluid) 7 was ejected from water ejection nozzles 6. A collision plate 42 made of metal was placed on the fall path of cooling water and a metal powder, the fall path being downstream of a position A, such that secondary cooling was performed in such a manner that falling cooling water after water atomization and the divided metal powder collided with the collision plate 42. After secondary cooling, the metal powder was collected from a collection port 13.

The size of the collision plate 42 made of metal was such that a surface perpendicular to the falling direction of the metal powder had an area with a diameter of 100 mmφ. This size is sufficient to allow substantially the whole of the falling metal powder after water atomization to collide therewith.

The shape of the collision plate 42 was one of an inverted conical shape (a), a disk shape (b), and a conical shape (c) as shown in FIG. 5. Needless to say, every shape was formed such that the plane perpendicular to the falling direction of the metal powder had substantially the above area.

A position A where a molten metal stream 8 was in contact with the jet water 7 was set to a position 80 mm apart from a molten metal guide nozzle 4. The collision plate 42 for secondary cooling was placed at a secondary cooling start position (position B). The position B was set to each position 100 mm to 800 mm apart from the position A. The ejection pressure of the jet water 7 was set to 3 MPa or 5 MPa and the temperature thereof was set to 40° C. (±2° C.) or 20° C. (±2° C.). The water temperature was adjusted with a chiller placed outside the cooling water tank. Incidentally, an example in which no collision plate 42 was placed (no secondary cooling was performed) was a comparative example. The surface temperature of the metal powder before secondary cooling and the MHF point of secondary cooling were estimated in substantially the same manner as that used in Example 1 and were listed together in a table.

After contaminants other than the obtained metal powder were removed, an amorphous halo peak and a crystalline diffraction peak of the metal powder were measured by X-ray diffractometry. The percentage of amorphousness (the degree of amorphousness: %) was calculated from the ratio between the integrated intensity of a diffracted X-ray from the amorphous halo peak and that from the crystalline diffraction peak in substantially the same manner as that used in Example 1. The case where the degree of amorphousness was 90% or more was rated "A" and the case where the degree of amorphousness was less than 90% rated "B" in substantially the same manner.

Obtained results are shown in Table 3.

In Powders No. 3-5 and No. 3-13, the shape of the collision plate 42 is conical (FIG. 5(C)) and is outside the preferable scope; hence, the effect of secondary cooling is little and the degree of amorphousness is low. However, the degree of amorphousness is higher than that of the case where no secondary cooling was performed.

In Powders No. 3-6 and No. 3-14, the installation position of the collision plate 42 is close to the position A, which is a position where a molten metal stream is divided; hence, the cooling start temperature of secondary cooling is high and the degree of amorphousness is slightly low though the degree of amorphousness is 90% or more.

In Powders No. 3-7 and No. 3-15, the installation position of the collision plate 42 is far apart from the position A, which is a position where a molten metal stream is divided; hence, the time until the start of secondary cooling is long, the surface temperature of the metal powder is low, cooling is slow, and the degree of amorphousness is slightly low though the degree of amorphousness is 90% or more. In Powders No. 3-8 and No. 3-16, the cooling start temperature is lower than a necessary cooling start temperature and the degree of amorphousness is less than 90%.

TABLE 3

| Powder | | Dividing-cooling (primary cooling) Water injection conditions | | Secondary cooling | | | | | | |
|---|---|---|---|---|---|---|---|---|---|---|
| | | Ejection pressure | Water temperature | Cooling start temperature | Cooling | Installation position B*** | MHF point | Degree of amorphization | | |
| No. | Composition | (MPa) | (° C.) | (° C.) | means**** | (mm) | (° C.) | (%) | Evaluation | Remarks |
| 3-1 | $Fe_{79}Si_{10}B_{11}$* | 3 | 20 | — | — | — | — | 56 | B | Comparative example |
| 3-2 | | 3 | 20 | 962 | Collision plate a | 300 | 970 | 95 | A | Inventive example |
| 3-3 | | 3 | 40 | 1010 | Collision plate a | 300 | 780 | 83 | B | Comparative example |
| 3-4 | | 3 | 20 | 963 | Collision plate b | 300 | 970 | 94 | A | Inventive example |
| 3-5 | | 3 | 20 | 965 | Collision plate c | 300 | Unclear | 82 | B | Comparative example |
| 3-6 | | 3 | 20 | 965 | Collision plate a | 100 | 970 | 91 | A | Inventive example |
| 3-7 | | 3 | 20 | 951 | Collision plate a | 400 | 970 | 91 | A | Inventive example |
| 3-8 | | 3 | 20 | 930 | Collision plate a | 800 | 970 | 84 | B | Comparative example |
| 3-9 | $Fe_{83}B_{17}$** | 5 | 20 | — | — | — | — | 53 | B | Comparative example |
| 3-10 | | 5 | 20 | 990 | Collision plate a | 300 | 1003 | 92 | A | Inventive example |
| 3-11 | | 5 | 40 | 1024 | Collision plate a | 300 | 840 | 89 | B | Comparative example |
| 3-12 | | 5 | 20 | 992 | Collision plate b | 300 | 1003 | 92 | A | Inventive example |
| 3-13 | | 5 | 20 | 988 | Collision plate c | 300 | Unclear | 72 | B | Comparative example |
| 3-14 | | 5 | 20 | 1002 | Collision plate a | 100 | 1003 | 91 | A | Inventive example |
| 3-15 | | 5 | 20 | 973 | Collision plate a | 400 | 1003 | 92 | A | Inventive example |
| 3-16 | | 5 | 20 | 942 | Collision plate a | 800 | 1003 | 88 | B | Comparative example |

*The critical cooling rate for amorphization is $1.8 \times 10^5$ K/s and the cooling start temperature necessary for amorphization is 950° C.

**The critical cooling rate for amorphization is $1.0 \times 10^6$ K/s and the cooling start temperature necessary for amorphization is 970° C.

***The distance from a water atomization position A (vertical direction).

****For a collision plate a, refer to FIG. 5(a); for a collision plate b, refer to FIG. 5(b); and for a collision plate c, refer to FIG. 5(c).

In every inventive example, the degree of amorphousness of a water-atomized metal powder is 90% or more. However, in comparative examples (Powders No. 3-1 and No. 3-9) in which no secondary cooling was performed, the degree of amorphousness is less than 90%. Incidentally, in some of the inventive examples that are outside a preferable scope of embodiments of the present invention, the degree of amorphousness is slightly low.

In Powders No. 3-3 and No. 3-11, the temperature of jet water (primary cooling water) for dividing a molten metal stream is higher than the preferable scope, the secondary cooling start temperature is higher than the MHF point, the time of cooling in a film boiling region is long, and the degree of amorphousness is low, less than 90%.

REFERENCE SIGNS LIST

1 Molten metal (molten metal)
2 Melting furnace
3 Tundish
4 Molten metal guide nozzle
5 Nozzle header
6 Water ejection nozzles
7 Jet water
8 Molten metal stream
8*a* Metal powder
9 Chamber
10 Hopper
11 Inert gas valve

12 Overflow valve
13 Metal powder collection valve
14 Water-atomized metal powder production apparatus
15 Cooling water tank
16 Chiller (low-temperature cooling water production apparatus)
17 High-pressure pump
18 Cooling water pipe
21 Secondary cooling water (cooling jet water)
22 Valves for secondary cooling water
26 Secondary cooling water ejection nozzles
27 High-pressure pump for secondary cooling water
28 Cooling water pipe for secondary cooling water
41 Container
42 Collision plate

The invention claimed is:

1. A method for producing a water-atomized metal powder, comprising applying water to a molten metal stream, dividing the molten metal stream into a metal powder, and cooling the metal powder, wherein the metal powder is further subjected to secondary cooling with cooling capacity having a minimum heat flux point (MHF point) higher than the surface temperature of the metal powder in addition to the cooling and the secondary cooling is performed from a temperature range where the temperature of the metal powder after the cooling is not lower than the cooling start temperature necessary for amorphization nor higher than the minimum heat flux point (MHF point), wherein the secondary cooling is cooling in which water ejection is performed using water different from water used to divide the molten metal stream.

2. The method for producing the water-atomized metal powder according to claim 1, wherein the cooling in which water ejection is performed is cooling in which jet water with a temperature of 10° C. or lower and an ejection pressure of 5 MPa or higher is used.

3. The method for producing the water-atomized metal powder according to claim 1, wherein the molten metal is composed of an Fe—B alloy or an Fe—Si—B alloy and the water-atomized metal powder is powder containing 90% or more of an amorphous metal powder.

4. The method for producing the water-atomized metal powder according to claim 2, wherein the molten metal is composed of an Fe—B alloy or an Fe—Si—B alloy and the water-atomized metal powder is powder containing 90% or more of an amorphous metal powder.

* * * * *